US005511364A

United States Patent [19]

Levi et al.

[11] Patent Number: 5,511,364

[45] Date of Patent: Apr. 30, 1996

[54] APPARATUS FOR PACKING PRODUCTS IN PREFORMED BAGS

[76] Inventors: Avraham Y. Levi, 757 Decorah La., St. Paul; Michel M. Rouache, 880 Cheri La.; Shimon Arosh, 2554 Whitfield Dr., both of Mendota Heights, all of Minn. 55120

[21] Appl. No.: 349,242

[22] Filed: Dec. 5, 1994

[51] Int. Cl.[6] ..... B65B 43/26

[52] U.S. Cl. ..... 53/570; 53/573; 53/258

[58] Field of Search ..... 53/570, 571, 573, 53/260, 258, 384.1

[56] References Cited

U.S. PATENT DOCUMENTS

| | | | |
|---|---|---|---|
| 2,833,097 | 5/1958 | Petrea et al. | 53/571 |
| 3,044,231 | 7/1962 | Blais et al. | 53/571 |
| 3,243,937 | 4/1966 | Ragan | 53/573 |
| 3,479,930 | 11/1969 | Peppler | 53/570 |
| 3,868,807 | 3/1975 | Noyes et al. . | |
| 4,242,854 | 1/1981 | Nissen | 53/573 |
| 4,779,403 | 10/1988 | Perrucchini | 53/573 |

*Primary Examiner*—John Sipos
*Assistant Examiner*—Ed Tolan
*Attorney, Agent, or Firm*—Haugen and Nikolai

[57] ABSTRACT

A packaging machine for penny packing products, such as bagels, bread, donuts, in pre-made plastic bags includes an endless chain carrying a plurality of regularly spaced bag grippers, the chain being entrained about sprocket wheels to define first and second flights. The bag grippers pick up a topmost bag from a stack while traversing the first flight and carry it to a bag filling station aligned with the second flight. An infeed conveyor has a plurality of transversely extending product trays containing the articles to be packaged which are transported with intermittent motion to the bag filling station in synchronism with the bag grippers. While the tray is stationary, movement of the bag gripper along the second flight draws the bag over the product-filled tray present at the bag filling station. A product pusher, synchronized with movement of the bag grippers and with the infeed conveyor, pushes the bagged products off the infeed conveyor onto a take-away conveyor.

11 Claims, 11 Drawing Sheets

APPARATUS FOR PACKING PRODUCTS IN PREFORMED BAGS

BACKGROUND OF THE INVENTION

I. Field of the Invention

This invention relates generally to high-speed packaging equipment, and more particularly to a machine for bagging a stack of articles oriented in side-by-side relation into pre-made bags.

II. Discussion of the Prior Art

Certain articles or products are of a size and shape that may make it difficult to package on a high-speed basis. For example, bagels or donuts, because of their size and shape, make them somewhat difficult to mechanically manipulate so that they can be placed in polyethylene bags in a stacked relationship. This is referred to in the industry as "penny packing" because of the similarity to the way in which coins are loaded into paper coin wrappers. While loaves of sliced bread have been successfully wrapped by machines such as described in U.S. Pat. No. 3,868,807 and manufactured by Foremost Packaging Machine Company of Woodinville, Wash., efforts to mechanize the penny packing of bagels, donuts, and the like, at high speeds have proven to be a challenge because of their more irregular shape.

While the present invention has been devised to penny pack food items, like bagels and donuts, those skilled in the art will appreciate that the machine to be described hereinbelow can also be used for packaging other food items, e.g., bread, as well as non-food items, by merely making minor modifications to the shape and size of various machine parts.

OBJECTS

It is accordingly a principal object of the present invention to provide an improved apparatus and method for inserting products in stacked relation within pre-formed plastic or paper bags.

Another object of the invention is to provide an improved packaging machine for placing articles, such as bagels, in plastic or paper bags on a continuous basis with very low machine down-time for cleaning, adjustment, maintenance and repair.

Yet another object of the invention is to provide a high-speed packaging machine for penny packing articles in pre-made bags that is simple in construction and which can be manufactured at a relatively low cost.

Still another object of the invention is to provide an improved packaging machine operating with a cycle time capable of producing bagged articles of a predetermined number of items per bag at a rate exceeding one per second.

SUMMARY OF THE INVENTION

The foregoing objects and advantages of the invention are achieved by constructing a packaging machine that includes a frame with an endless chain disposed about sprocket wheels mounted on the frame so that the chain defines first and second flights. The chain is adapted to be driven by an electric motor, and secured to the chain are a plurality of bag grippers that are designed to pick up a topmost bag from a stack of pre-formed bags as the gripper traverses one or the other of the first and second flights and then carries the bag to a bag filling station located in the other of the first and second flights. A product infeed conveyor transports trays of products to be packaged to the bag filling station where the products are temporarily held stationary and are oriented in a horizontally stacked relation. A bag carried by a bag gripper is drawn over a tray of products disposed in the bag filling station as the bag gripper moves in the other of the first and second flights.

The packaging machine further includes a product take-away conveyor whose head end is positioned adjacent the bag filling station. A product pusher synchronized with the movement of the bag gripper and the product infeed conveyor is used to displace bag covered products from the bag filling station onto the product take-away conveyor. The desired synchronization is achieved by providing a rotatable indexing cam that is coupled to the electric motor driving the endless chain to which the bag grippers are affixed. The indexing cam has a cam profile thereon that cooperates with a cam follower that is operatively coupled to the infeed conveyor for controlling acceleration and deceleration thereof in a controlled fashion that reduces the effects of inertia on the products being carried. The product pusher is driven in a timed, reciprocating fashion through the bag filling station by means of a chain driven roller that periodically engages a shuttle mechanism to which the pusher is attached.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which.

DESCRIPTION OF THE PREFERRED EMBODIMENT

Figure 1:
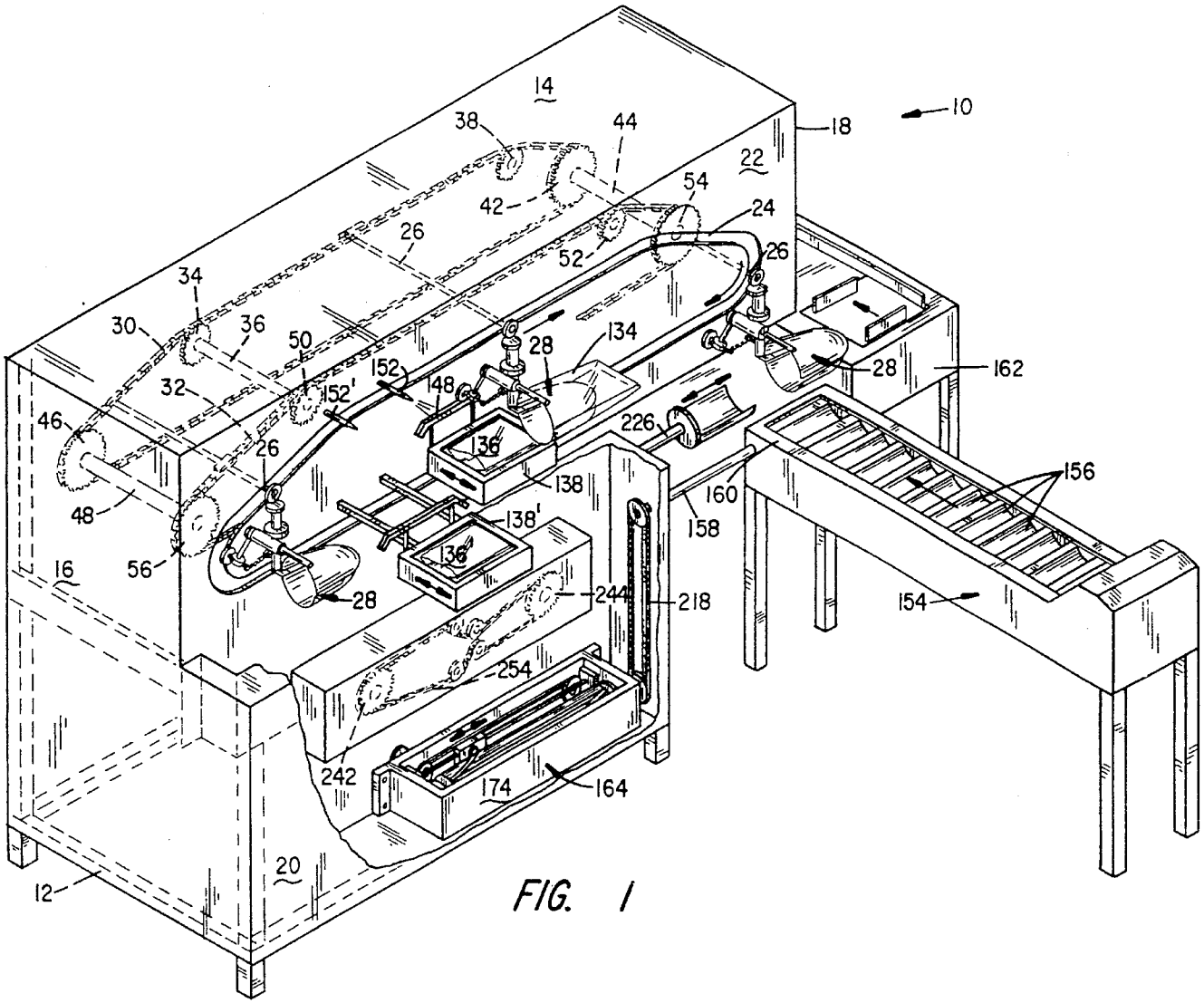
FIG. 1 is a perspective view of the packaging machine of the present invention.

Referring first to FIG. 1, there is indicated generally by numeral 10 the packaging machine comprising a preferred embodiment of the present invention. It is seen to include a structural frame, portions of which are identified by numeral 12. It may be fabricated out of steel tubes having a generally rectangular cross-section. The frame 12 is covered by sheet metal panels configured to shield the internal working mechanism of the packaging machine 12. Specifically, a top panel 14 is affixed to the frame 12 as are left and right end panels 16 and 18, respectively. A front panel 20 is partially broken away to better reveal certain internal working mechanism which will be described in greater detail hereinbelow.

Figure 2:
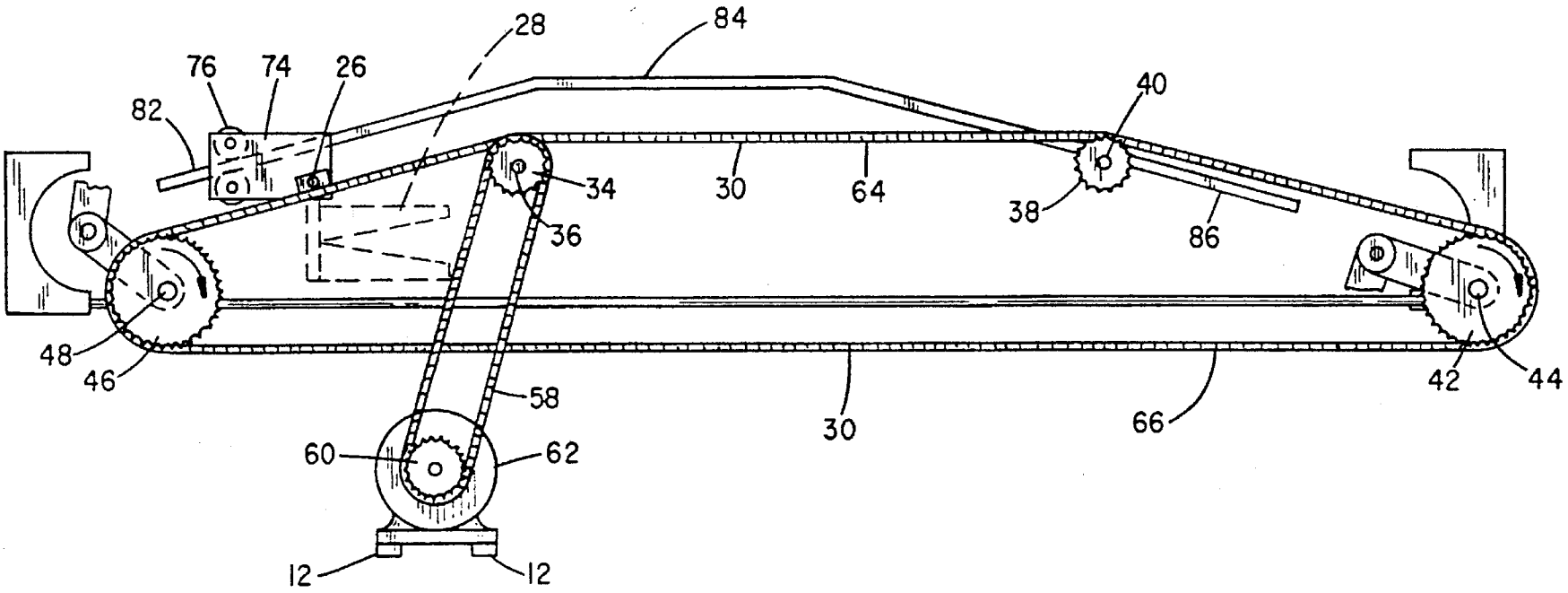
FIG. 2 is a side elevation of the chain assembly for transporting the bag grabbers.

An upper front panel 22 has an orbital slot 24 formed therethrough and shown projecting out through the slot 24 are a plurality of bag grabber support arms 26, each supporting a bag grabbing assembly 28. As will be described in greater detail below, the support arms 26 are affixed to links on a pair of chains 30 and 32 which are deployed about sprocket wheels mounted on common shafts so that the chains 30 and 32 will traverse their orbital path in unison and in parallel, spaced-apart relation. More particularly, and as shown in FIGS. 1 and 2, the chain 30 is deployed about a drive sprocket 34 mounted on a shaft 36, about an idler sprocket 38 affixed to a shaft 40 about a first end sprocket 42 affixed to a shaft 44 and about a second end sprocket 46 affixed to a shaft 48. Also affixed to the driven shaft 36 in parallel, spaced-apart relationship to the drive sprocket 34 is a drive sprocket 50 that cooperates with the chain 32. Chain 32 is deployed about an idler sprocket 52 on the shaft 40 and, thence, about end sprocket 54 that is affixed to the shaft 44 supporting sprocket 42. Finally, the endless chain 32 passes about end sprocket 56 that is affixed to the same shaft 48 as the sprocket 46. The shaft 36 has affixed to it a further sprocket (not shown) that is coupled by a chain 58 to a sprocket wheel 60 secured to the output shaft of a clutch (not shown) that is driven by an electric motor 62 mounted on structural frame members 12.

The drive sprocket 34 and the idler sprocket 38 being out of a coplanar relationship relative to the shafts 44 and 48 of the end sprockets 42 and 46 effectively causes the two chains to be divided into a first (upper) flight 64 and a second (lower) flight 66.

Figure 3:
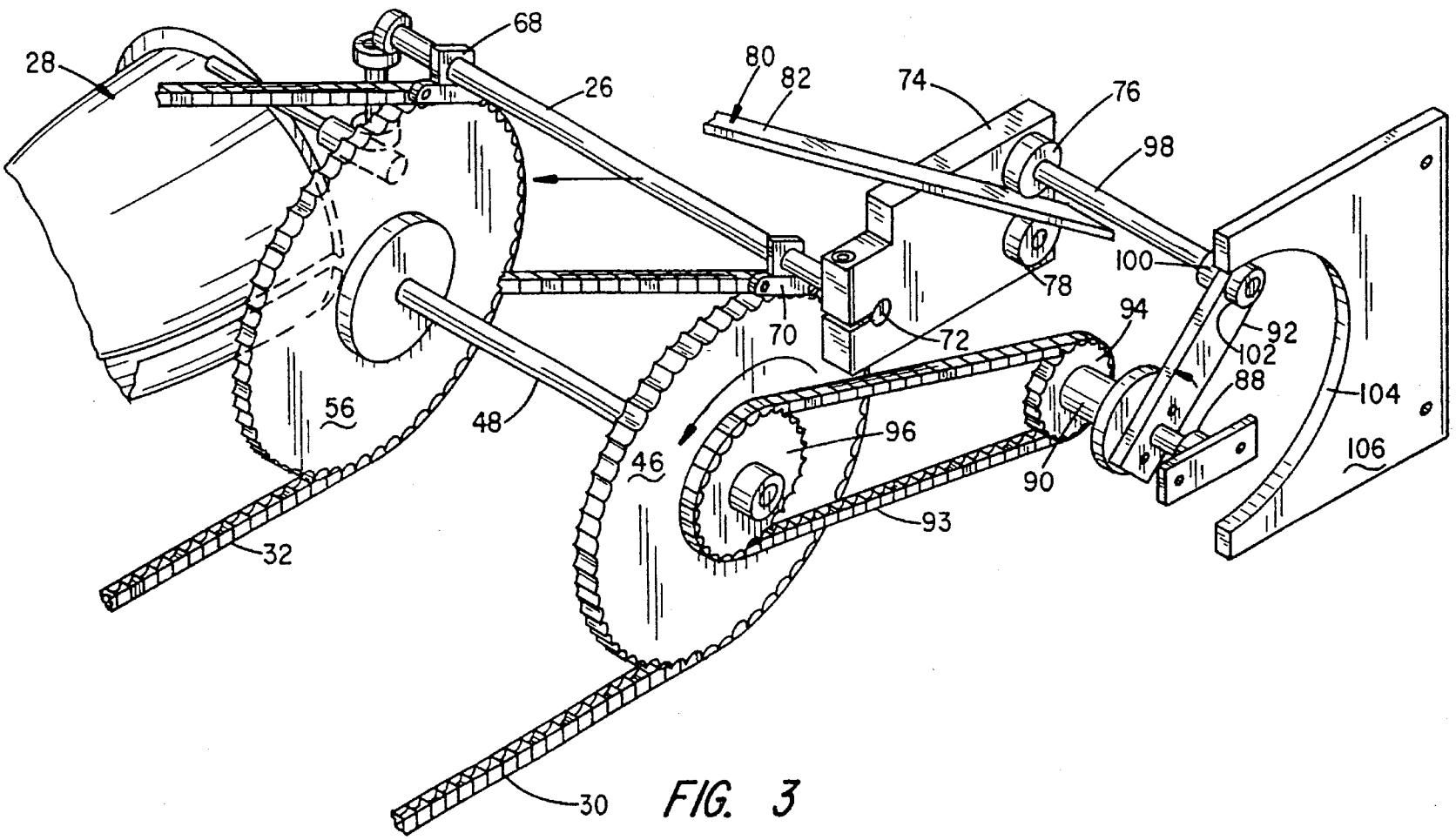
FIG. 3 is a detailed perspective view of a portion of the chain assembly of FIG. 2 showing the mechanism for allowing the bag grabber support arms to pass over the end sprockets.

The partial perspective view of FIG. 3 is helpful in understanding the manner in which the bag grabber assemblies 28 are coupled to the parallel, spaced apart chains 30 and 32. Specifically, links of the two chains directly across from one another are replaced with specially shaped links 68 and 70 having an outwardly projecting stub with an aperture therethrough for receiving the cylindrical support arm member 26 therethrough. It can be appreciated that by virtue of this connection, the arm 26 at all times remains parallel to the shafts supporting the chain sprocket wheels throughout the entire orbital path defined by chains 30 and 32.

Affixed to the end portion 72 of the support arm 26 is a cam follower mounting block 74 to which a pair of cam rollers 76 and 78 are journaled. The cam rollers cooperate with an elongated cam member 80 that is divided into an ascending ramp portion 82 (FIG. 3), a horizontal cam portion 84 (FIG. 2) and a descending ramp portion 86 (FIG. 2). The cooperation between the cam rollers 76 and 78 and the cam member 80 insures that the support arms 26 will remain aligned with the orbital slot 24 formed in the front cover member 22 to maintain the orientation of the bag grabbers; also the chains 30 and 32 would otherwise sag between their support points at the several sprocket wheels.

With continued reference to FIG. 3, the mechanism used to assist the cam mounting block 74 in traversing the arcuate path about the sprocket wheels 46 and 56 will be described. Mounted to the frame proximate the pairs of end sprocket wheels 42, 54 and 46, 56 is a journal bearing 88 supporting a stub shaft 90 to which is affixed a lifter arm 92 and a chain sprocket wheel 94. A short, endless chain 93 is deployed over the sprocket wheel 94 and about a further sprocket wheel 96 affixed to and rotatable with the shaft 48. An identical assembly is associated with the end sprocket 42.

The axle 98 on which the cam roller 76 is mounted extends laterally outward and affixed to the end thereof is a further roller 100. This roller 100 is adapted to be received in a arcuate groove 102 formed in the end of the lifter arm 92 and it also cooperates with a semicircular recess 104 formed in a guide plate 106 also mounted to the frame.

When it is recognized that the bag grabbers 28 are spaced from one another by a predetermined distance equal to an integral number of revolutions of the end sprocket wheels 46 and 56, it can be appreciated how the arm 92 can be made to arrive at a precise time to engage the roller 100 so as to provide support to the cam follower mounting block 74 to maintain it in a horizontal disposition as it traverses the turn and again positions the elongated cam member 80 between the cam follower rollers 76 and 78.

Figure 4:
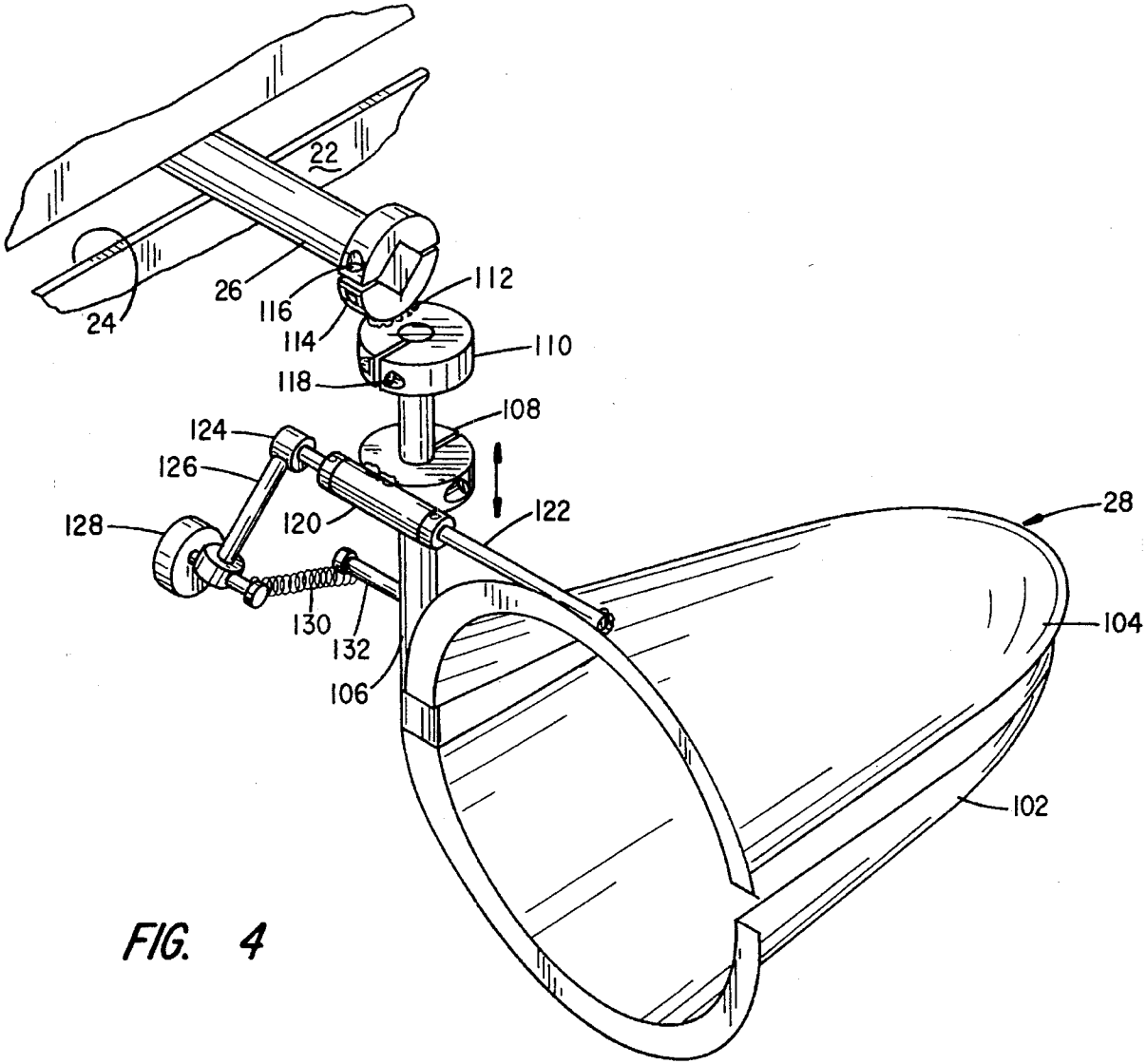
FIG. 4 is a detailed perspective drawing of the bag grabbers used in the packaging machine of FIG. 1.

FIG. 4 is a detailed drawing of one of the bag grabbing mechanisms forming part of the packaging machine 10 of FIG. 1. The bag grabbers 28 each comprise first and second curved sheet metal jaws 102 and 104 that are suspended from the arm 26 that projects laterally outwardly through the slot 24 formed in the front panel 22 of the machine. The lowermost jaw 102 is welded or otherwise positively affixed to a shaft 106 which passes through first and second clamping rings 108 and 110. The clamping ring 110 is welded at 112 to a similar clamping ring 114 assembled onto the end of arm 26. This allows the entire assembly 28 to be adjusted in the lateral or horizontal direction by loosening the cap screws 116 and sliding the ring 114 along the shaft 26 to a desired position and then retightening the screw 116. Likewise, vertical adjustment of the bag grabber can be achieved by loosening the cap screw 118 on the clamping ring 110 and shifting the shaft 106 before retightening that cap screw.

The clamping ring 108 has welded to it a bearing sleeve 120 and passing through the bearing sleeve is a cylindrical rod 122 to which the jaw 104 is attached. Secured to the other end of the rod 122 is a crank assembly including a hub 124 and a crank arm 126. Journaled to the end of the crank arm 126 opposite the hub 124 is a cam follower roller 128. A tension spring 130 is operatively coupled between the crank arm 126 and a pin 132 affixed to the shaft 106 to normally spread the jaws 102 and 104 apart from one another.

Figure 5:
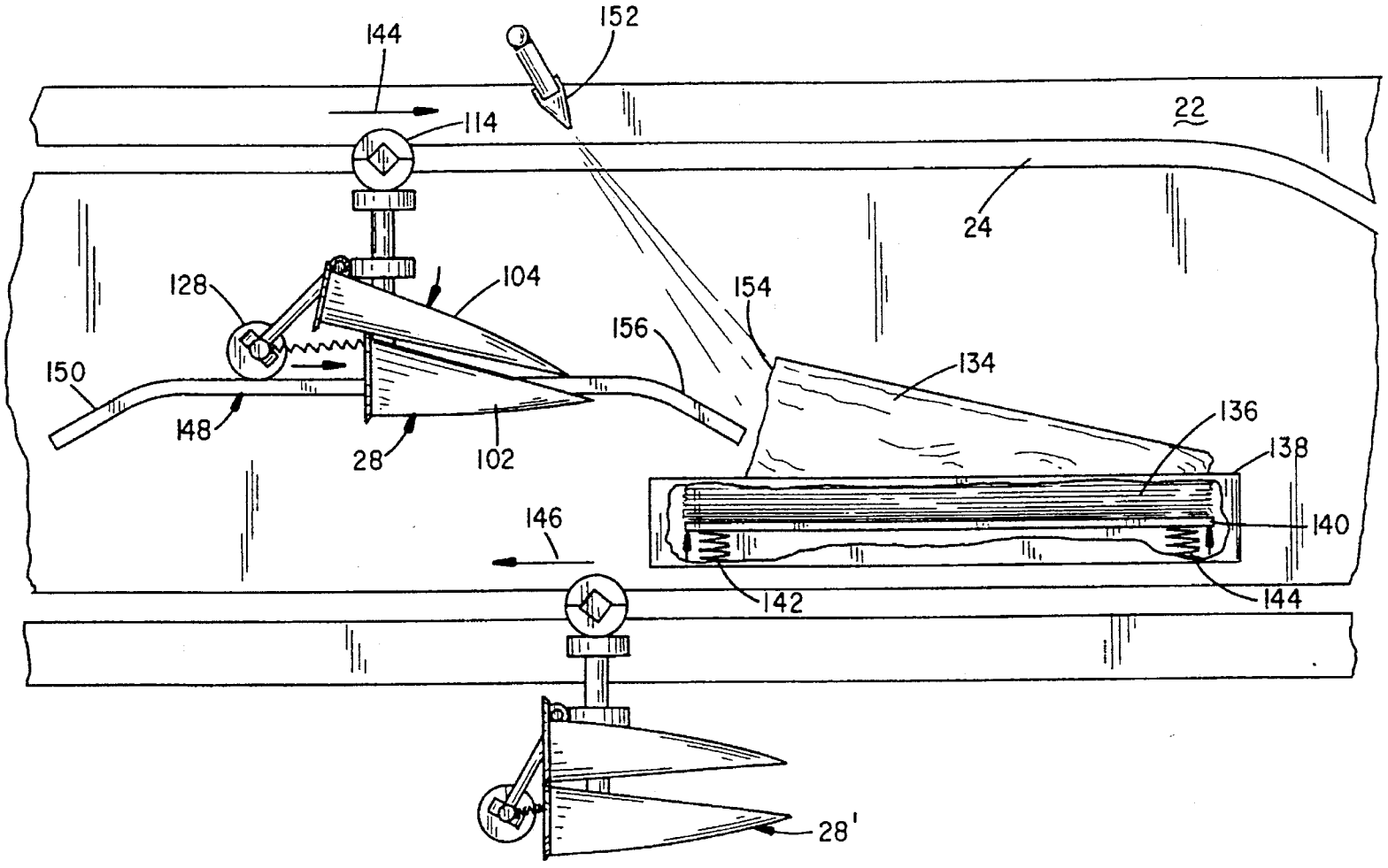
FIG. 5 is a side elevation showing the bag grabber selecting a top bag from a stack of pre-formed bags.

The view of FIG. 5 helps illustrate the manner in which a bag grabber is able to pick a preformed bag 134 from a stack 136 of preformed bags. The stack is contained in a box 138 having a push-down bag support tray 140 that is normally biased in an upward direction by compression springs 142 and 144 operatively disposed between the floor of the box 138 and the push-down tray 140. The bag grabber 28 is assumed to be carried by the chains 30 and 32 in the direction indicated by arrow 144 in FIG. 5 while another bag grabber 28' is being carried in the opposite direction by the bottom flight of the chains. As the bag grabber 28 moves in the direction of arrow 144, its cam wheel 128 engages a cam rail 148 affixed to box assembly 138 and as the cam follower roller 128 rides up the ascending ramp portion 150 thereof, the crank comprising the arm 126 and shaft 122 causes the moveable jaw member 104 to tip to the orientation illustrated in FIG. 5 where the jaws 102 and 104 are closed. A sensor, not shown, is positioned so that as the leading edges of the closed jaws 102 and 104 approach the stack of bags 136, a jet of air is made to exit the nozzle 152 which is directed at the stack of bags causing the uppermost bag 133 to open. As the bag grabber 28 continues its forward movement, the leading edges of the jaws 102 and 104 enter the open mouth 154 of the bag. Then, as the cam follower roller 128 follows the descending portion 156 of the ramp, the jaws 102 and 104 again spread apart to hold the bag thereon as the bag grabber and bag continue their travel to the bag filling station of the packaging machine 10.

As shown in FIG. 1, to reduce the down-time of the packaging machine, it has been found expedient to include two bag supply box assemblies 136 and 136' slidably mounted to the frame so that when one box of bags becomes empty, the second box can be slid into position in the path of travel of the orbiting bag grabbers while the empty one is retracted for refilling.

The packaging machine 10 of the present invention includes an infeed conveyor indicated generally by numeral 154. It is shown as including a plurality of arcuate trays 156 to be filled with the products to be wrapped. The trays extend between first and second side chains (not shown) which are driven by sprockets affixed to the infeed conveyor drive shaft 158. The head end portion 160 of the infeed conveyor 154 is made to abut the front of the packaging machine 10 so that the endmost tray is in the path of travel of the bag grippers as the support arm 26 thereof passes around the end sprockets 46, 56. Positioned adjacent to the head end 160 of the infeed conveyor 154 is a product take-away conveyor 162. This comprises a simple belt-style conveyor which leads to a bag closing station (not shown).

Figure 7:
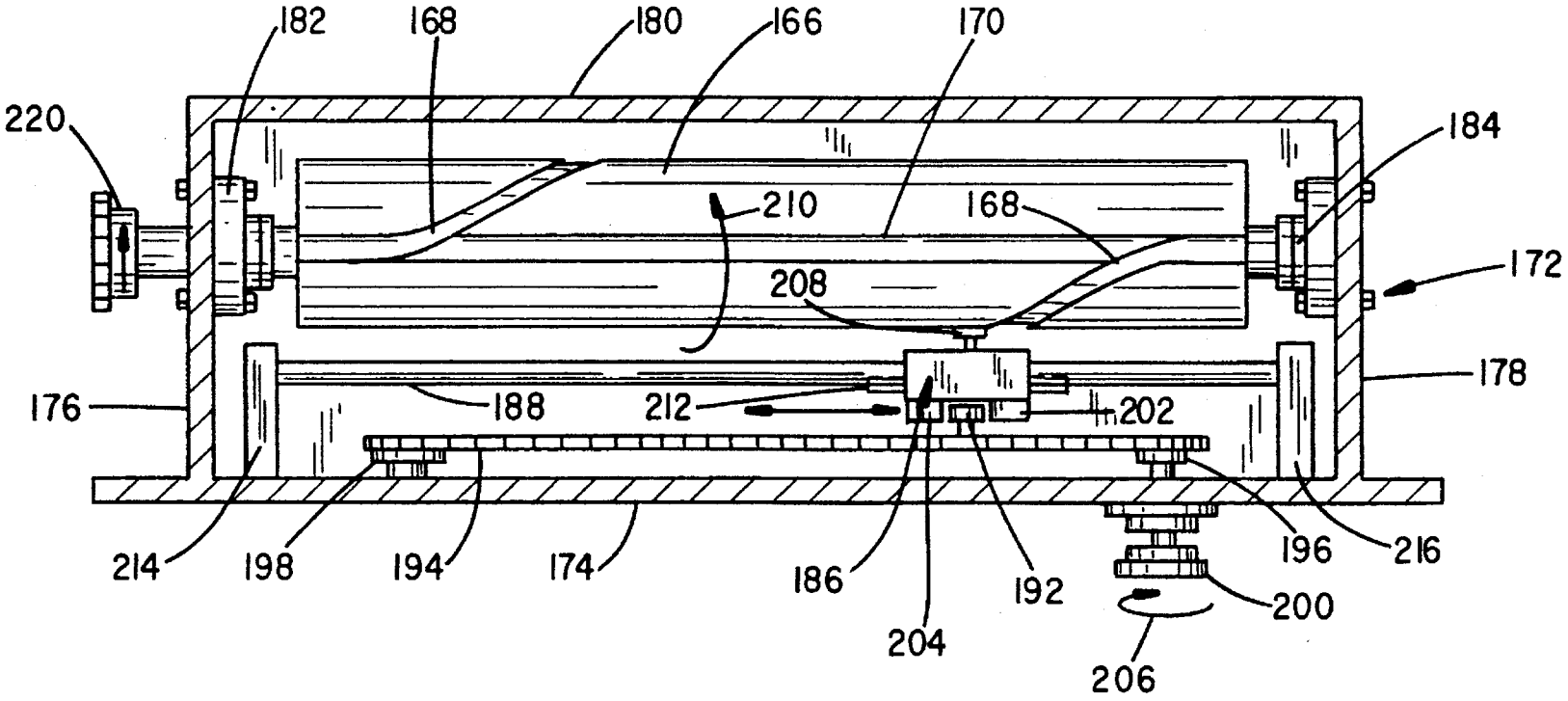
FIG. 7 is a detailed drawing illustrating the indexing mechanism for driving the infeed conveyor in synchronism with the movement of the bag grabbers.

The infeed conveyor is moved in step-wise fashion under control of an indexing mechanism indicated generally by numeral 164 in FIG. 1 and shown in greater detail in the view of FIG. 7. To drive the infeed conveyor 154 intermittently and with controlled acceleration and deceleration so that the products to be bagged do not become misaligned, the infeed conveyor indexing or stepping mechanism includes a rotary cam cylinder 166 containing a somewhat helical path defined by a first groove 168 and a second path defined by straight longitudinal groove 170. The groove 168 is preferably of a depth greater than that of groove 170 and is machined to effect an acceleration and deceleration defined by a parabolic curve to the cam follower as it traverses the groove 168.

Figure 8:
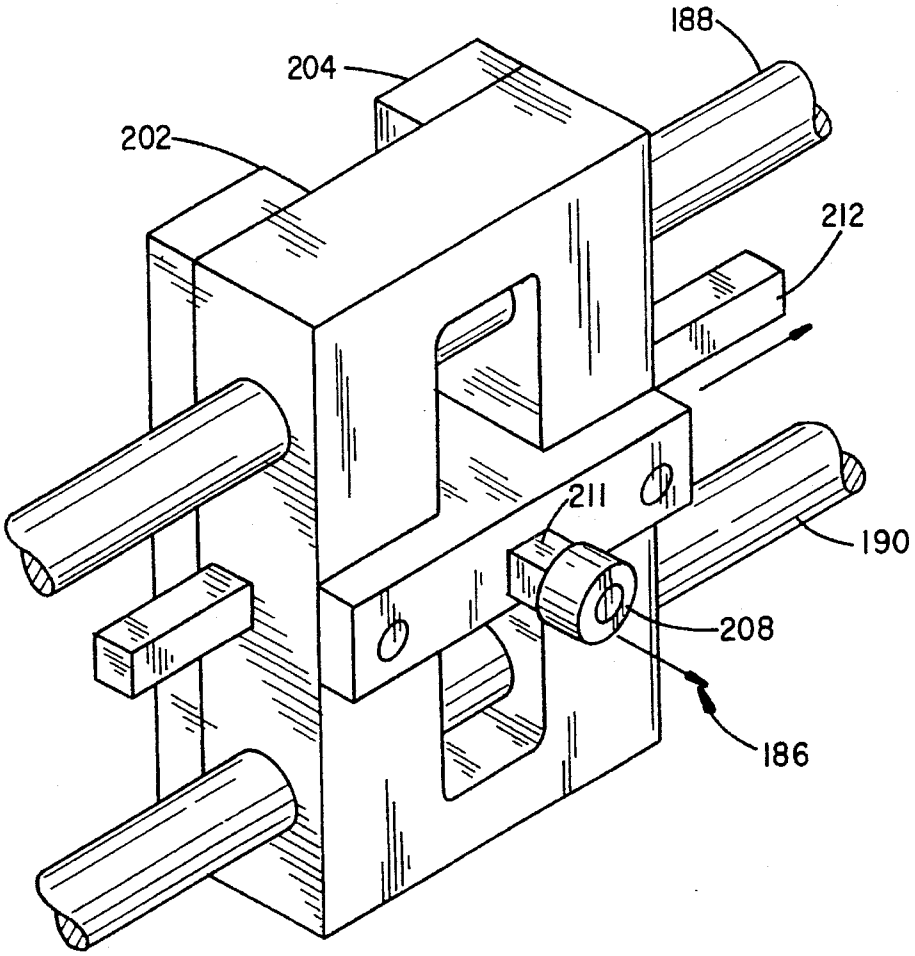
FIG. 8 is a perspective view of the cam follower assembly used in the device of FIG. 5.

The cylindrical cam 166 is journaled for rotation in a frame member 172. The frame member is seen to comprise a front plate 174, opposed end plates 176 and 178 and a rear plate 180. Bearing blocks 182 and 184 affixed, respectively, to end plates 176 and 178 allow for the rotation of the cam cylinder 166 when it is driven by the reciprocal movement of a cam follower assembly 186. The cam follower assembly is illustrated with greater particularity in FIG. 8.

The cam follower assembly 186 is arranged to be driven in a reciprocating fashion along cylindrical guide rails 188 and 190 by the engagement therewith of a roller 192 affixed to an endless chain 194 deployed about a driven sprocket 196 and an idler sprocket 198 journaled for rotation on the front plate 174. The drive sprocket 196 is driven, via a chain (not shown), deployed about the sprocket 200 and about a further sprocket that is driven by the same motor 62 as is used for driving the parallel chains 30 and 32 that carry the bag grabber assemblies. The chain mounted roller 192 is positioned between two parallel, spaced-apart bars 202 and 204 that are bolted or otherwise affixed to the carriage assembly 186. It can be seen that when the sprocket 200 is driven in the direction indicated by the arrow 206, the carriage 186 will be moved to the left, as depicted in FIG. 7, until the roller 192 comes around the sprocket wheel 198, and begins pushing the carriage member in the opposite direction.

Projecting outwardly from the carriage assembly is a cam follower roller 208 that engages the arcuate groove 168 causing the cylindrical cam to rotate in the direction of arrow 210 as the carriage moves to the left. The cam roller 208 is journaled for rotation on a laterally extending shaft 211 that is driven by a toggle mechanism controlled by an actuator bar 212. Shifting of the actuator bar 212 causes the shaft 211 to extend and retract relative to the remainder of the carriage assembly 186.

Referring to FIG. 7, as the carriage assembly 186 moves all the way to the left, the end of the actuator bar 212 will engage the support leg 214 for the guide rails 188 and 190 thereby forcing the actuator bar 212 to the right. This movement causes the shaft 211 to retract into the actuator assembly and thus traverse the linear groove 170 on the return movement of the carriage assembly 186. During the interval that the roller 208 is traversing the linear groove 170, the cam cylinder 166 remains stationary. As the carriage assembly 186 approaches the sprocket wheel 196, the right-most end of the actuator bar 212 will strike the rail support 260 causing the actuator bar to toggle to its other position, forcing the cam roller 208 to project outward and into the deeper arcuate groove 168.

A chain 218 (FIG. 1) is deployed about the sprocket wheel 220 driven by the cam cylinder 166 and about a further sprocket affixed to the drive shaft 158 of the infeed conveyor. Thus, as the cam follower assembly 186 reciprocates back and forth along guide rails 188 and 190, the conveyor drive shaft 158 will be intermittently rotated in stepwise fashion with a controlled acceleration and deceleration determined by the profile of the groove 168 on the cam cylinder 166. It will remain stationary, however, for the time interval that the carriage assembly 186 has its cam follower roller 208 deployed in the linear tracker groove 170 of the cam cylinder.

Figure 6:
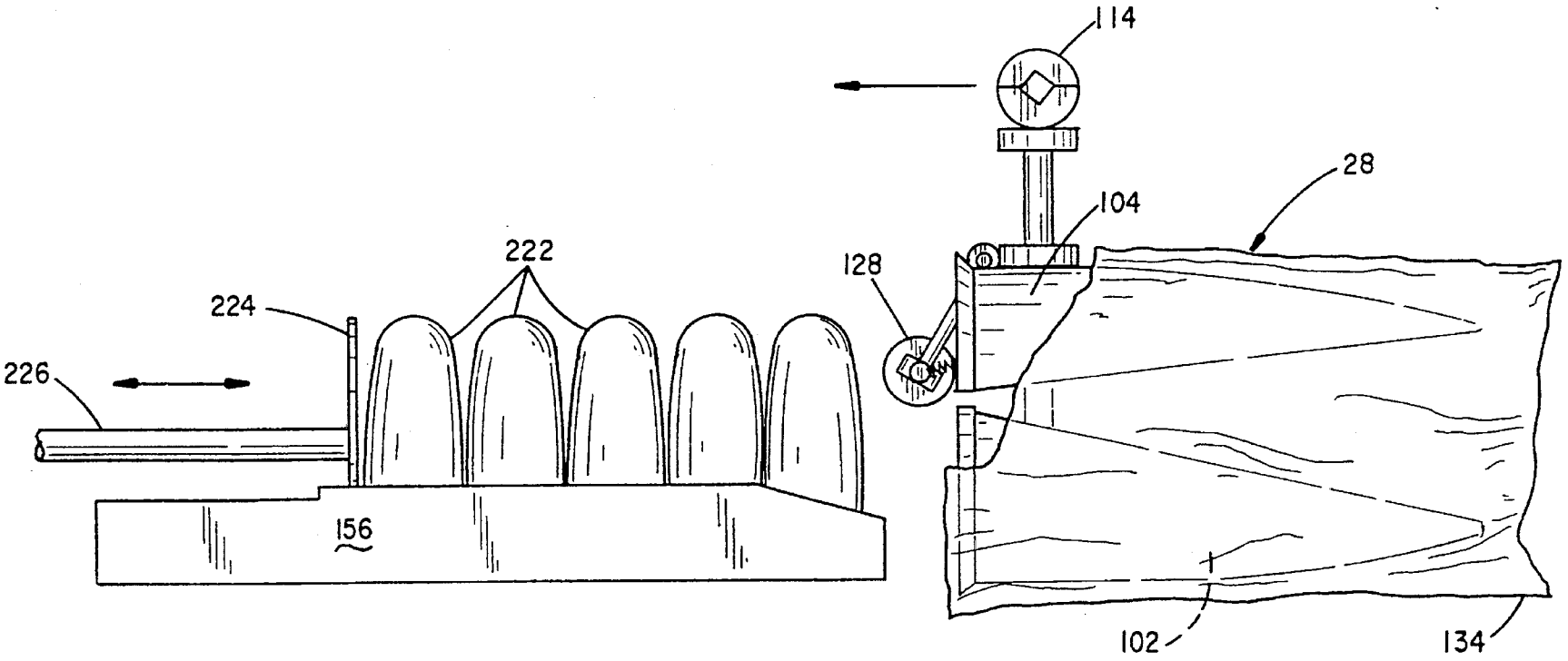
FIG. 6 is a side elevation of the bag grabber with a bag loaded thereon and being drawn over products to be wrapped that are disposed at the machine's bag filling station.

With reference to FIG. 6, there is shown one of the trays 156 on the infeed conveyor after it has moved to the bag filling station. Positioned within the tray 156 are a plurality of articles, such as bagels, to be placed in a pre-made bag. The articles to be packaged are identified by numeral 222 and are seen to be stacked in side-by-side relation to one another in the tray. The bag grabber assembly 28 has moved from the upper flight of the drive chains 30 and 32 to the lower flight and as it carries the bag 134 leftward (when viewed in FIG. 6), it passes over the now-stationary tray 156 containing the articles 222 to be packaged and when those articles are fully contained within the bag, a reciprocating pusher 224 that is affixed to a push rod 226 is driven to the right to thereby push the products along with the bag in which they are now contained off of the stationary tray 156 and onto the take-away conveyor 162.

Figure 9:
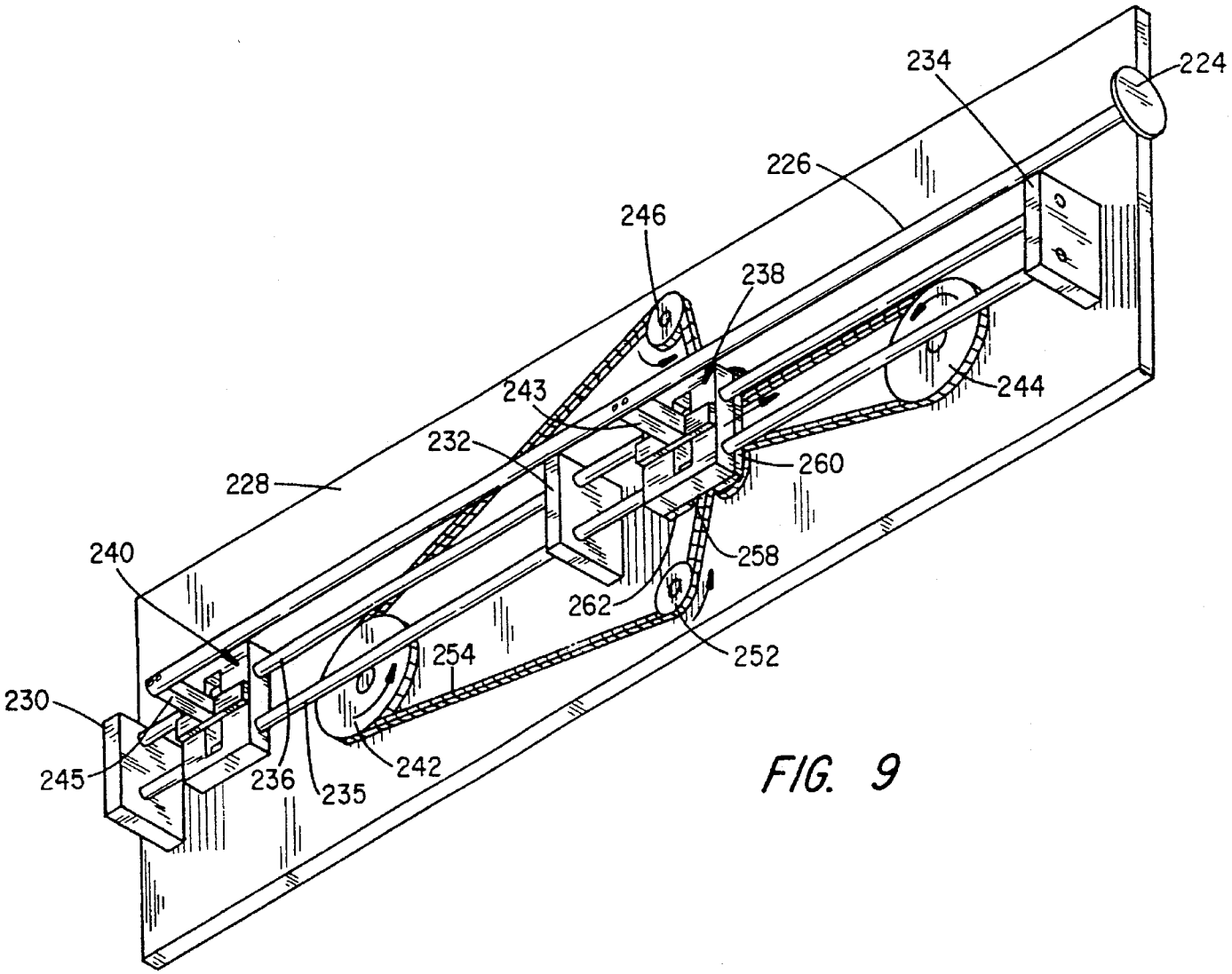
FIG. 9 is a perspective view of the pusher actuating mechanism.
Figure 10:
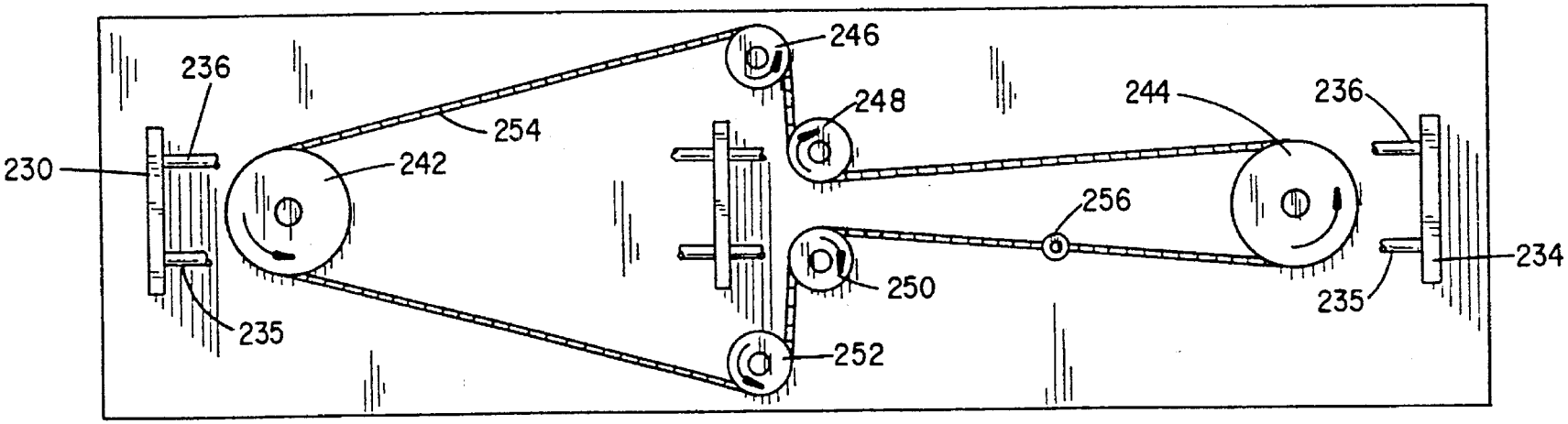
FIG. 10 is a side elevation of the device of FIG. 9 with the pusher and shuttle mechanism removed for clarity.

With reference to FIGS. 9 and 10, the mechanism for synchronizing the movement of the push rod 226 will be explained. The push rod drive assembly comprises mounting plate 228 having a plurality of guide rail mounting blocks 230, 232 and 234 affixed to it and projecting outwardly from a flat surface thereof. Aligned bores are formed through the mounting blocks 230, 232 and 234 for receiving elongated cylindrical guide rails 235 and 236 therethrough. Assembled on to the guide rails 235 and 236 are push rod carriage assemblies 238 and 240.

Journaled for rotation on the support plate 228 are a plurality of sprocket wheels, including end sprocket wheels 242 and 244 along with intermediate sprocket wheels 246, 248, 250 and 252. An endless chain 254 is deployed about the sprockets in the way illustrated in FIG. 10 and disposed on the chain is a roller bearing 256 which is carried by the chain through the path defined by the several sprocket wheels.

The push rod 226, itself, is affixed to outwardly projecting support legs 243 and 245 attached to the carriage members 238 and 240, respectively. Thus, as the carriage members 238 and 240 move reciprocally along their associated guide rails 235 and 236, the push rod 226 will also move in a reciprocal fashion. To cause the reciprocal movement, as the chain is driven in the direction indicated by the arrows on the sprocket wheels 242 and 244 in the drawings, the roller 256 will fall into a slot 258 that is defined between two parallel, spaced-apart bars 260 and 262 affixed to the carriage member 238. As the roller 256 moves to the left, as viewed in FIGS. 9 and 10, it will first be contained within the slot 258 until the carriage assembly 238 approaches the sprocket wheel 244. The diameter of the sprocket wheel 244 is such that the roller 256 will come free of the slot 258 as the roller traverses the periphery of the sprocket 244 such that the carriage assembly 238 remains momentarily stationary. The roller 256 will again engage the slot in the carriage assembly 238 as it moves to the left along the upper flight of the chain 254. This will then allow the carriage assembly and the attached push rod to be carried back to the left and out of the bag filling station until the carriage assembly 238 reaches the position shown in FIG. 9 where the roller 256 is again withdrawn from the slot 258 and carried about the sprocket wheels 246, 242 and 252. Upon rounding the sprocket wheel 252, the roller 256 can again engage the slot 258 in the carriage member 238 to advance the carriage to the right to thereby cause the push rod to force the bagged articles unto the take-away conveyor.

By controlling the length of the chain extending between the sprockets 246, 242 and 252 relative to the length of chain extending around sprocket wheels 250, 244 and 248, the movement of the push rod can be synchronized with the operation of the infeed conveyor in transporting articles to the filling station and the movement of the bag grabber with its attached bag through the filling station.

Figure 11:
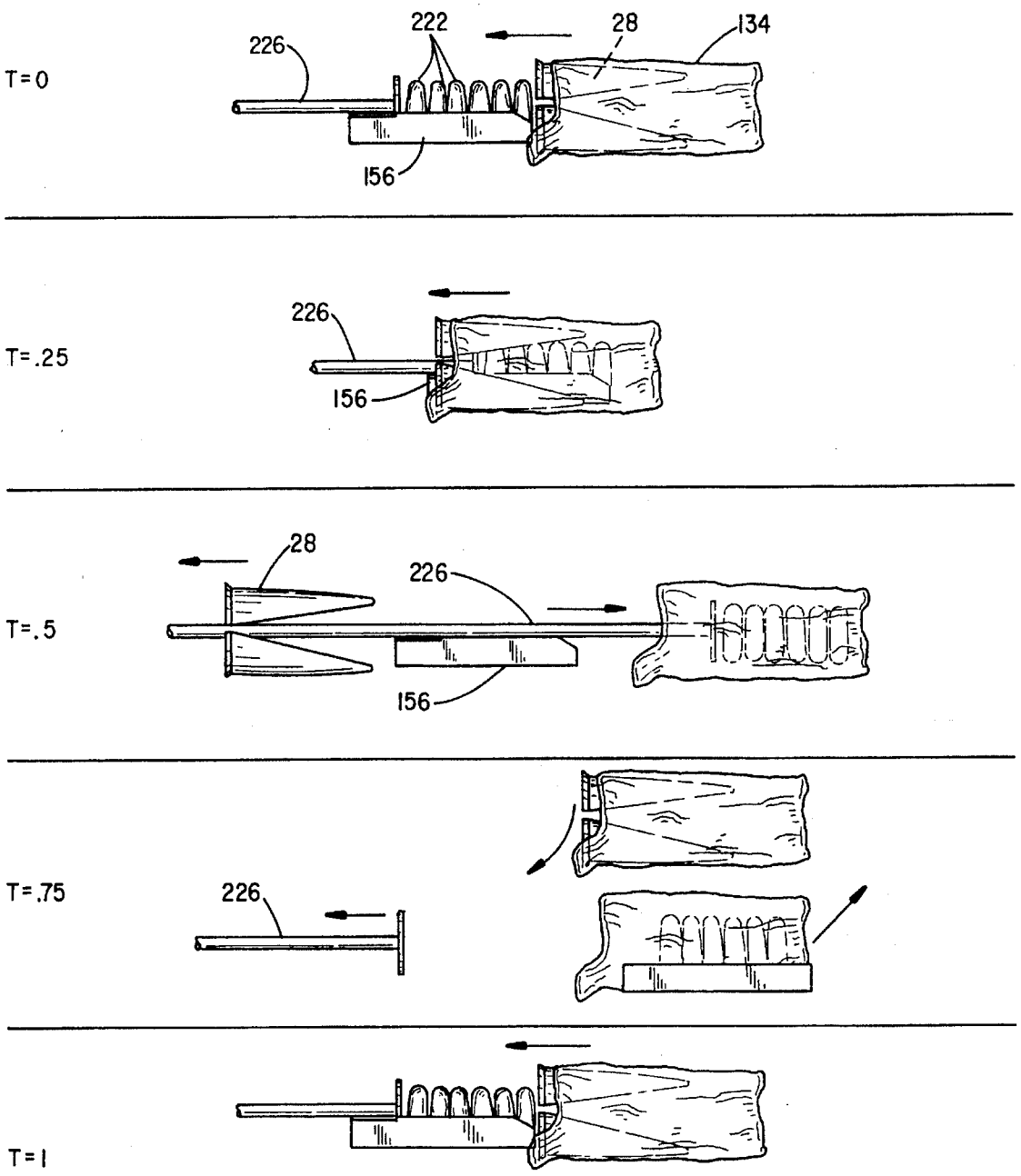
FIG. 11 comprises a schematic timing diagram helpful in understanding the sequencing of the machine elements of FIG. 1.

Summarizing the operation, and with reference to the timing diagram of FIG. 11, the cycle is presumed to start at T=0 with a bag grabber 28, having a bag 134 thereon, arriving at the bag filling station where an infeed conveyor, tray 156, filled with products 222, awaits. Approximately one-fourth of a second later, the bag grabber and associated bag in moving to the left has allowed the bag to have been drawn over the products. Approximately a quarter of a second later at T=0.5, the push rod 226 is advanced rightward as the now-empty bag grabber 28 moves to the left. The pusher causes the bagged articles to be deposited into the take-away conveyor. At T=0.75, the next bag grabber and bag is moving from its upper flight toward the bag filling station as the next tray of products moves on the infeed conveyor to the bag filling station. At this time, the push rod 226 has again been caused to retract. At T=1, the bag grabber and next bag are at the same position as at T=0, initiating the start of the next cycle.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A packaging machine for packing products in preformed bags, comprising:

(a) a frame;

(b) an endless chain disposed about sprocket wheels mounted to the frame so that the chain defines first and second flights;

(c) means supported by the frame for continuously driving the endless chain about the sprocket wheels in an orbital path without arresting the movement of said endless chain during the packing operation;

(d) bag gripping means carried by the endless chain for picking up a topmost bag from a stack of pre-formed bags as the bag gripping means is traversing one of the first and second flights and for sequentially carrying the bags to a bag filling station in the other of the first and second flights; and (e) a bag filling station at which bags carried by the bag gripping means are filled with a plurality of products arranged in corresponding groups, the products in each group being arranged sequentially relative to one another, means for holding said products a stationary while bag carried by the bag gripping means is being drawn over the group of products disposed at the bag filling station as the bag gripping means moves continuously in the other of the first and second flights.

2. The packing machine as in claim 1 wherein the products in each group are arranged in side-by-side relation.

3. The packaging machine in claim 1 further including product infeed conveyor means for transporting products to be packaged in the bag filling station.

4. The packaging machine as in claim 3 further including:

(a) a product take-away conveyor having a head end positioned adjacent said bag filling station; and (b) pusher means synchronized with the continuous movement of the bag gripping means and intermittent movement of the product infeed conveyor means for displacing bag covered products from the infeed conveyor means onto the product take-away conveyor.

5. The packaging machine as in claim 4 wherein the infeed conveyor means includes a plurality of trays for receiving groups of products to be packaged and means for synchronizing movement of the trays of products on the infeed conveyor means with the movement of the bag gripping means and with the pusher means.

6. The packaging machine as in claim 5 wherein the means for synchronizing movement of the trays of products includes means for intermittently advancing the trays of products to the bag filling station, whereby a tray of products at the bag filling station is stationary as the bag carried by the continuous moving bag gripping means is being drawn over the tray of products at the bag filling station.

7. The packaging machine as in claim 1 wherein the bag gripping means comprises:

(a) an arm coupled to said endless chain; and (b) first and second arcuate jaw members, the first jaw member having a pivot rod pivotally joined to the arm and the second jaw member being fixed to the arm with a predetermined spacing between the first and second jaw members.

8. The packaging machine as in claim 7 and further including a cam follower affixed to the pivot rod and cooperating with a cam surface affixed to the frame to cause the first and second jaw members to close relative to one another as they approach the stack of preformed bags and to reopen after entry of the closed jaw members into a mouth of the topmost bag on the stack.

9. The packaging machine as in claim 8 and further including means for biasing the first and second jaw members to an opened condition.

10. The packaging machine as in claim 5 wherein the synchronizing means includes:

(a) a rotatable indexing cam coupled to the means for driving the chain, the indexing cam having a predetermined cam profile; and (b) a cam follower cooperating with the cam profile, the cam follower being operatively coupled to the infeed conveyor for controlling acceleration and deceleration thereof.

11. A method for bagging a plurality of longitudinally positioned articles in a pre-formed bag, comprising the steps of:

(a) providing a packaging machine having a plurality of empty, pre-formed bags arranged in a stack proximate an orbital track and having a bag grabbing means traveling with continuous motion along the orbital track for picking up a bag from the stack;

(b) providing a bag filling station proximate the orbital track and an infeed means for intermittently feeding groups of positioned articles to the bag filling station;

(c) picking up a bag from the stack with the bag grabbing means as it moves continuously in a first direction and carrying the bag to the bag filling station;

(d) drawing the bag over the articles located in the bag filling station by moving the bag grabbing means carrying the bag in a direction opposite to the first direction; and (e) pushing the article filled bag onto to a take-away conveyor.

* * * * *